US009620133B2

(12) United States Patent
Yang et al.

(10) Patent No.: US 9,620,133 B2
(45) Date of Patent: Apr. 11, 2017

(54) WATERMARK INSERTION IN FREQUENCY DOMAIN FOR AUDIO ENCODING/DECODING/TRANSCODING

(71) Applicants: Qi Yang, North York, CA (US); Jie Feng, Scarborough, CA (US)

(72) Inventors: Qi Yang, North York, CA (US); Jie Feng, Scarborough, CA (US)

(73) Assignee: VIXS SYSTEMS INC., Toronto (CA)

( * ) Notice: Subject to any disclaimer, the term of this patent is extended or adjusted under 35 U.S.C. 154(b) by 418 days.

(21) Appl. No.: 14/096,959

(22) Filed: Dec. 4, 2013

(65) Prior Publication Data

US 2015/0154972 A1 Jun. 4, 2015

(51) Int. Cl.

*G10L 19/00* (2013.01)
*G10L 19/018* (2013.01)
*G10L 19/02* (2013.01)

(52) U.S. Cl.

CPC ..... *G10L 19/018* (2013.01); *G10L 19/02* (2013.01)

(58) Field of Classification Search

CPC ..... G06T 2201/0052; G06T 2201/0051; G06T 2201/0061; G06T 1/0028; G06T 1/005; G06T 2201/0053; G06T 2201/0083; H04N 21/23892; H04N 19/48; H04N 1/32165; H04N 21/8358; G10L 19/018; G10L 19/0212; G10L 21/00

USPC ..... 704/500, 273, 203; 726/32; 725/31; 713/176; 382/100; 341/143

See application file for complete search history.

(56) References Cited

U.S. PATENT DOCUMENTS 6,157,330 A * 12/2000 Bruekers ..... G06T 1/0035 341/143
6,157,938 A * 12/2000 Wu ..... G06F 17/142 708/404
6,185,312 B1 * 2/2001 Nakamura ..... G06T 1/0057 283/113

(Continued)

FOREIGN PATENT DOCUMENTS

WO 9929114 A1 6/1999
WO 0105075 A1 1/2001

OTHER PUBLICATIONS

European Search Report corresponding to European Application No. 14192035.5, mailed on Apr. 15, 2015, 5 pages.

*Primary Examiner* — Michael Colucci

(57) ABSTRACT

An audio processing device includes an initial processing module to generate a stream of frequency coefficients based on input audio data, a watermarking module to embed a digital watermark into the stream of frequency coefficients to generate a modified stream of frequency coefficients, and a final processing module to process the modified stream of frequency coefficients to generate output audio data. In some implementations, the input audio data comprises unencoded audio data, the initial processing module comprises a frequency domain transform module to perform a time-to-frequency domain transform to generate the unencoded audio data, and the output audio data is encoded audio data. In other instances, the input audio data comprises encoded audio data, the initial processing module comprises an initial decoding module to partially decode the encoded audio data to generate the stream of frequency coefficients, and the output audio data is decoded audio data.

14 Claims, 4 Drawing Sheets

(56) References Cited

U.S. PATENT DOCUMENTS

| | | | | |
|---|---|---|---|---|
| 6,425,082 | B1 * | 7/2002 | Matsui | G10L 19/018 380/207 |
| 6,614,914 | B1 * | 9/2003 | Rhoads | G06F 17/30876 382/100 |
| 6,665,420 | B1 * | 12/2003 | Xie | G06T 1/0035 380/54 |
| 6,725,372 | B1 * | 4/2004 | Lewis | G06T 1/0035 375/E7.089 |
| 7,058,979 | B1 * | 6/2006 | Baudry | G06T 1/005 375/E7.026 |
| 7,152,161 | B2 * | 12/2006 | Bruekers | G06T 1/0064 382/277 |
| 7,299,189 | B1 * | 11/2007 | Sato | G10L 19/018 704/500 |
| 8,099,285 | B2 * | 1/2012 | Smith | G10L 19/018 380/236 |
| 9,001,888 | B2 * | 4/2015 | Henry | H04N 19/176 375/240.02 |
| 9,037,454 | B2 * | 5/2015 | Yoon | G10L 19/0212 704/203 |
| 2002/0131617 | A1 * | 9/2002 | Pelly | G06T 1/0064 382/100 |
| 2003/0079222 | A1 * | 4/2003 | Boykin | H04N 7/1675 725/31 |
| 2007/0014428 | A1 * | 1/2007 | Kountchev | G06T 1/0028 382/100 |
| 2007/0238415 | A1 * | 10/2007 | Sinha | G10L 19/0208 455/66.1 |
| 2008/0292133 | A1 * | 11/2008 | Planitz | G06T 1/0092 382/100 |
| 2009/0044072 | A1 * | 2/2009 | Oh | H04L 12/189 714/758 |

* cited by examiner

WATERMARK INSERTION IN FREQUENCY DOMAIN FOR AUDIO ENCODING/DECODING/TRANSCODING

FIELD OF THE DISCLOSURE

The present disclosure generally relates to audio processing and, more particularly, to watermark insertion during audio processing.

BACKGROUND

A watermark, which is a type of digital marker, often is embedded into audio data to identify the owner or source of the audio data for copyright protection purposes or to transfer other non-audio information. Typically, a watermark is added to audio data prior to encoding or after encoding. However, this approach renders the watermark relatively easy to detect and modify, and thus susceptible to tampering or removal by unauthorized entities.

BRIEF DESCRIPTION OF THE DRAWINGS

The present disclosure may be better understood, and its numerous features and advantages made apparent to those skilled in the art, by referencing the accompanying drawings.

DETAILED DESCRIPTION

FIGS. 1-4 illustrate example techniques for watermarking audio data while it is represented as frequency coefficients in the frequency domain as a result of a time-to-frequency domain transform process. In at least one embodiment, an initial processing module generates sets of frequency coefficients from input audio data. Watermark data is embedded into the audio data by modifying at least some frequency coefficients of each set based on the watermark data to generate modified sets of frequency coefficients. A final processing module then completes the processing of the audio data using the modified sets of frequency coefficients to generate output data having the watermark data so embedded. in an encoding context, the input audio data is unencoded audio data and the initial processing module includes a frequency domain transform module that performs a time-to-frequency domain transform process on the unencoded audio data to generate the sets of frequency coefficients. The final processing module in this context includes the final encoding process that utilizes the modified sets of frequency coefficients to complete the encoding of the audio data, and thus generating encoded audio data as the output audio data. The time-to-frequency domain transform process can include a discrete cosign transform (DCT)-based transform process, such as a modified DCT (MDCT) process, or a Fourier-based process, such as a Fast Fourier Transform (FFT) process. In a decoding context, the input audio data include encoded audio data and the initial processing module can include an initial decoding module that extracts the sets of frequency coefficients from the encoded multimedia data, and the final processing module includes a final decoding module that completes the audio decoding process using the modified sets of frequency coefficients. In a transcoding operation, the modification of the filter coefficients for watermarking can occur during the decoding of the input encoded audio data or during the encoding of the resulting audio data for output.

In some embodiments, watermark data is embedded in the sets of frequency coefficients by modifying at least a subset of frequency coefficients of a set based on a corresponding bit of the watermark data. This modification can include, for example, a linear add of one value if the corresponding bit value is a 0, and a linear add of a different value if the corresponding bit value is a 1. Each frequency coefficient of the set may be so modified, or only a subset of the frequency coefficients of the set may be modified. By modifying the frequency coefficients on a set-by-set basis in this manner, the watermark may be embedded in the audio data in a manner that permits detection of the presence of the watermark using, for example, an average detector or most-likelihood detector as known in the art, while also being more resilient to unauthorized tampering than conventional time-domain watermarking techniques.

Figure 1:
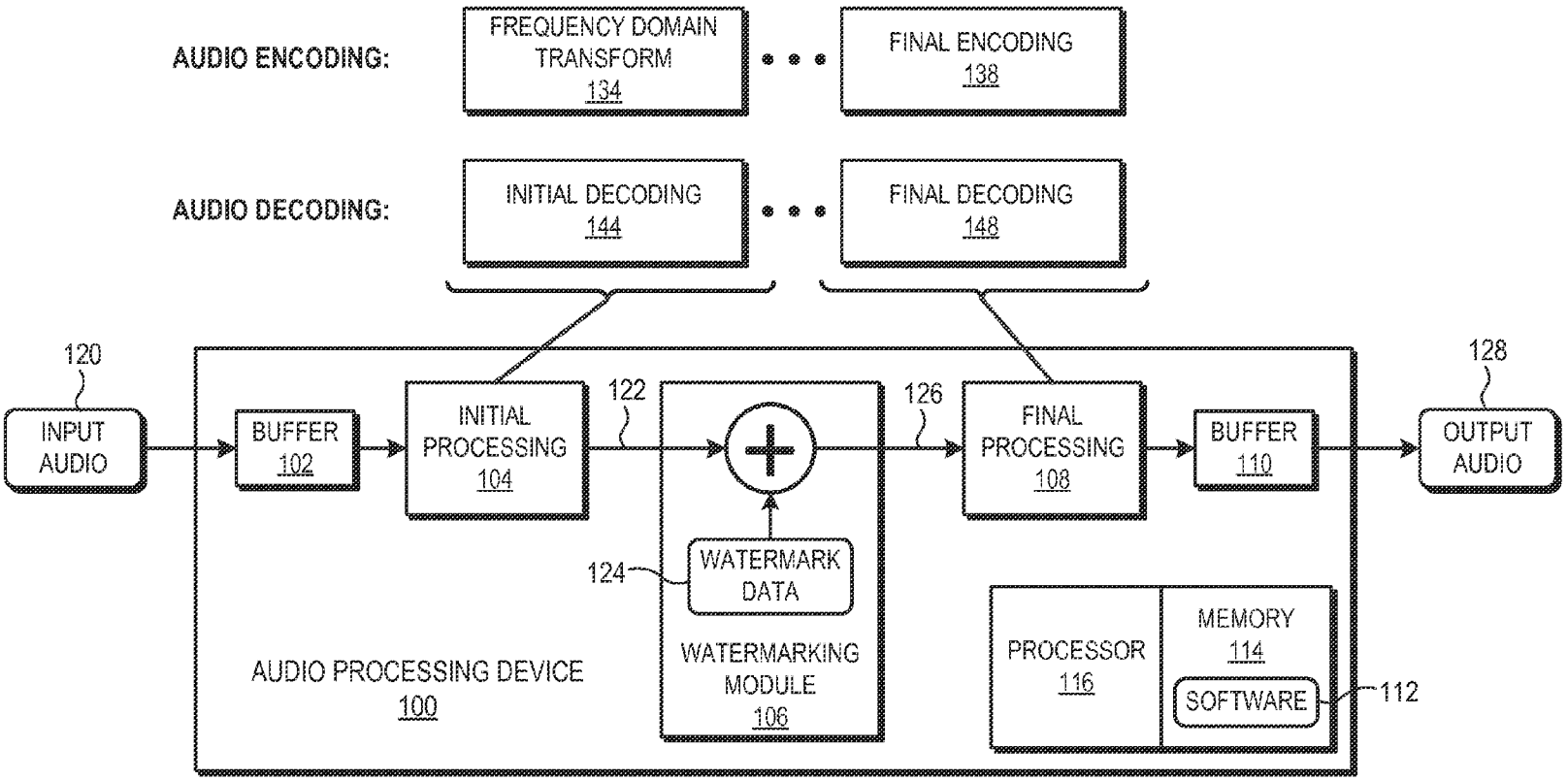
FIG. 1 is a block diagram illustrating an audio processing device implementing watermarking in the frequency domain in accordance with at least one embodiment of the present disclosure.

FIG. 1 illustrates, in block diagram form, an audio processing device 100 in accordance with at least one embodiment of the present disclosure. The audio processing device 100 can represent any of a variety of audio processing devices in which encoding, decoding, or transcoding of audio can be advantageously used. To illustrate, the audio processing device 100 can be implemented as part of a multimedia processing system used to encode, decode, or transcode the audio data in association with corresponding video content. Alternatively, the audio processing device can be implemented as a stand-alone system used to generate processed audio content independent of any video content, such as audio content representing musical songs, audiobooks, and the like.

In the depicted example, the audio processing device 100 includes an input buffer 102, an initial processing module 104, a watermarking module 106, a final processing module 108, and an output buffer 110. The initial processing module 104, watermarking module 106, and final processing module 108 each may be implemented entirely in hard-coded logic (that is, hardware), as a combination of software 112 stored in a non-transitory computer readable storage medium (e.g., a memory 114) and one or more processors 116 to access and execute the software, or as combination of hard-coded logic and software-executed functionality. To illustrate, in one embodiment, the audio processing device 100 is implemented as a system on a chip (SOC) whereby portions of the modules 104, 106, and 108 are implemented as hardware logic, and other portions are implemented via firmware (one embodiment of the software 112) stored at the SOC and executed by a processor 116 of the SOC.

The hardware of the audio processing device 100 can be implemented using a single processor 116 or a plurality of processors 116. Such processors 116 can include a central processing unit (CPU), a graphics processing unit (GPU), microcontroller, a digital signal processor, a field programmable gate array, programmable logic device, state machine, logic circuitry, analog circuitry, digital circuitry, or any device that manipulates signals (analog and/or digital) based on operational instructions that are stored in the memory 114 or other non-transitory computer readable storage medium. The memory 114 may be a single memory device or a plurality of memory devices. Such memory devices can include a hard disk drive or other disk drive, read-only memory, random access memory, volatile memory, non-volatile memory, static memory, dynamic memory, flash memory, cache memory, and/or any device that stores digital information. Note that when the processing module implements one or more of its functions via a state machine, analog circuitry, digital circuitry, and/or logic circuitry, the memory storing the corresponding operational instructions may be embedded within, or external to, the circuitry comprising the state machine, analog circuitry, digital circuitry, and/or logic circuitry.

As a general operational overview, the audio processing device 100 receives input audio data 120 from an audio source (e.g., a live recording, pulse code modulated audio data from a CD or DVD, etc.) and buffers the input audio data 120 as it is received at the input buffer 102. The initial processing module 104 then processes the buffered input audio data 120 to generate sets of frequency coefficients that represent a time-to-frequency transform of at least a portion of the audio data 120. This output of sets of frequency coefficients is referred to herein as a stream 122 of frequency coefficients. The watermarking module 106 then embeds watermark data 124 by modifying some or all of the frequency coefficients of some or all sets of the stream 122 to generate modified sets of frequency coefficients (referred to herein as "modified stream 126 of frequency coefficients"). The modified stream 126 of frequency coefficients then is used by the final processing module 108 to generate output audio data 128, which may be buffered in the output buffer 110 before being transmitted to an intermediary or final destination.

In some embodiments, this processing is performed in the context of the audio processing device 100 as an encoding system such that the input audio data 120 is unencoded audio data (e.g., pulse code modulation (PCM) data representative of the original analog audio waveform) and the output audio data 128 is encoded audio data, such as audio data encoded in accordance with one or more of a version of the Advanced Audio Coding (AAC) standard, aversion of the Motion Pictures Experts Group (MPEG) 2 Audio Level 3 (MP3) standard, and the like. In this implementation, the initial processing module 104 comprises a frequency domain transform module 134 that performs a time-to-frequency domain transform of the input audio data 120 to generate the stream 122 of frequency coefficients. The frequency domain transform module 134 thus can apply, for example, a Discrete Cosign Transform (DCT)-based transform, such as a Modified DCT (MDCT) transform, a Fourier-based transform, such as a Fast Fourier Transform (FFT), and the like. Further, for an encoding-based implementation, the final processing module 108 comprises a final encoding module 138 to generate an encoded audio stream as the output audio data 128 from the modified stream 126 of frequency coefficients using any of a variety of audio encoding techniques that employ time-to-frequency domain transforms, such as the aforementioned AAC and MP3 standards.

In other embodiments, the processing of the audio processing device 100 is directed to a decoding context such that the input audio data 120 is encoded audio data, such as AAC-encoded or MP3-encoded audio data and the output audio data 128 is decoded audio data (e.g., PCM audio data). In a decoding implementation, the input audio data 120 already includes the frequency coefficients, albeit in some coded form, and thus the initial processing module 104 comprises an initial decoding module 144 to perform initial decoding sufficient to extract the stream 122 of frequency coefficients from the encoded input audio data 120. The decoding necessary to obtain these frequency coefficients depends on the manner in which the input audio data 120 was encoded. Further, the final processing module 108 includes a final decoding module 148 to perform the final decoding process using the modified stream 126 of frequency coefficients to generate the decoded output audio data 128 in accordance with the encoding standard employed to encode the input audio data.

In still other embodiments, the processing of the audio processing device 100 is directed to a transcoding context such that the input audio data 120 is encoded audio data and the output audio data 128 is encoded audio data, whereby the audio processing device 100 modifies the resolution, bitrate, or format of the input audio data 120 to generate the output audio data. In such instances, as such transcoding involves at least partial decoding and subsequently at least partial re-encoding, the digital watermarking process may be employed at either or both of the encoding process or decoding process as described in greater detail below.

Figure 2:
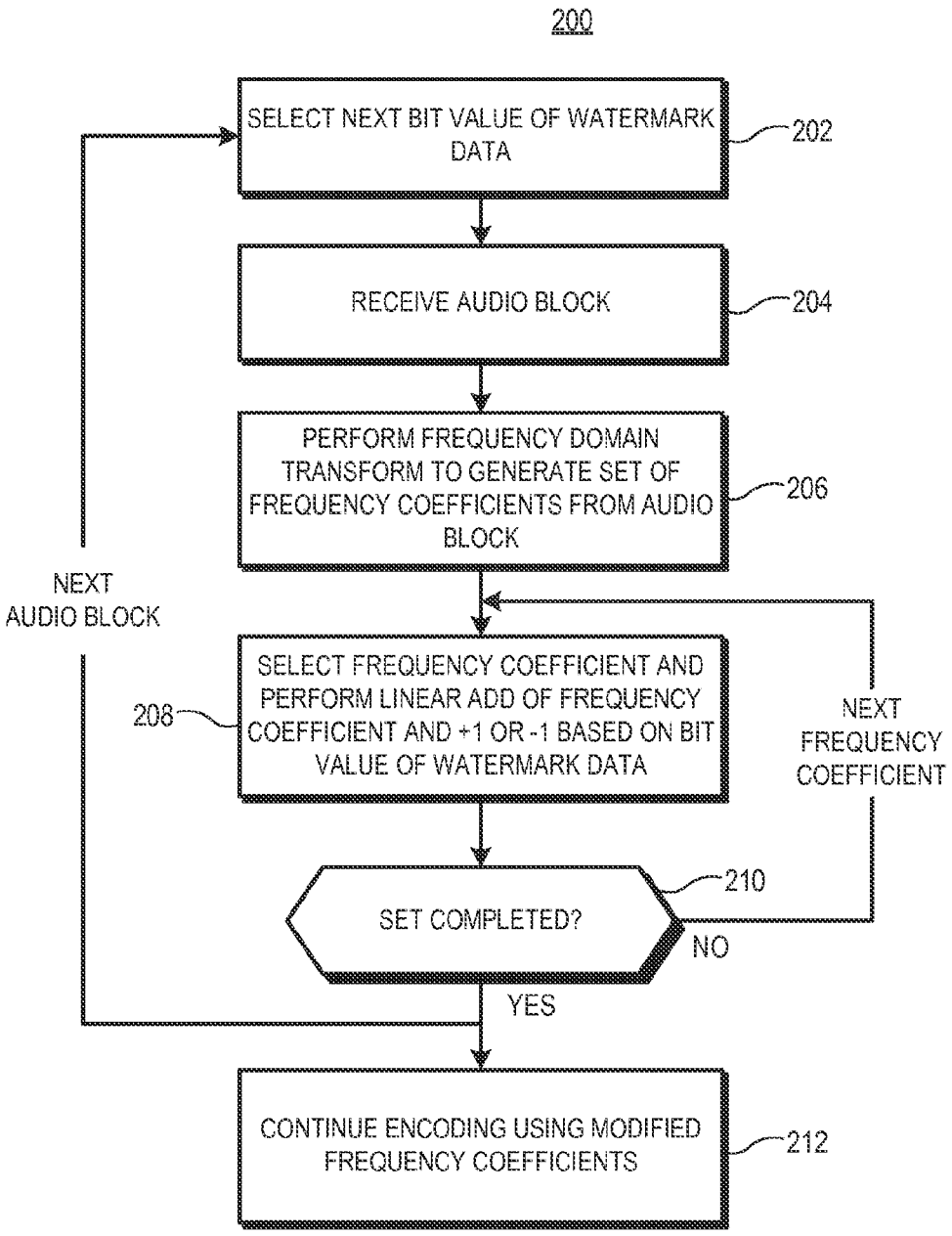
FIG. 2 is a flow diagram illustrating an operation of the audio processing device for watermarking during an audio encoding process in accordance with at least one embodiment of the present disclosure.

FIG. 2 illustrates an example method 200 of operation of the audio processing device 100 of FIG. 1 in an encoding context in accordance with at least one embodiment. The watermark data 124 to be embedded in the audio data is composed of a set of bits, such as one or more bytes of information. These bits can represent, for example, a unique value associated with the source of the audio data or other unique identifier, an indicator of a geographical region, an encryption/decryption key, and the like. As described in greater detail below, each bit of the watermark data 124 is embedded in the frequency coefficients of a corresponding block of audio data (that is, an "audio block"), where the audio block comprises, for example, audio data of a fixed duration (e.g., 20 milliseconds of audio data). Accordingly, in a first iteration of the method 200, the watermarking module 106 selects the first bit value of the watermark data 124 at block 202. At block 204, the audio processing device 100 receives and buffers an audio block of the input audio data 120, whereby the audio block comprises a corresponding portion of an unencoded audio file or other stream (e.g., a block of PCM data). At block 206, the frequency domain transform module 134 performs a frequency domain transform (that is, a transform from the time domain to the frequency domain) to generate a set of frequency coefficients from the audio block for inclusion in the stream 122 of frequency coefficients supplied to the watermarking module 106. The frequency domain transform can include, for example, a MDCT process, a FFT process, and the like. The frequency domain transform employed by the initial decoding module 144 can comply with the time-to-frequency domain transform process specified by one or more audio encoding standards, such as AAC, MP3, and the like.

Next, at block 208, a frequency coefficient of the set is selected and the watermarking module 106 performs a linear add using the selected frequency coefficient and one of a first value or a second value that is selected depending on whether the bit value of the watermark data 124 selected at block 202 is a "0" or a "1".To illustrate, if the bit value of the watermark data 124 is a "0" the linear add operation can add a "−1" to the frequency coefficient, and if the bit value of the watermark data 124 is a "1" the linear add operation can add a "+1" to the frequency coefficient. Any arrangement of value pairs used in the linear add operation based on watermark bit value may be used rather than "−1, +1", such as, for example, "−10, +10" or "−3, +6", etc. The resulting modified frequency coefficient is output as part of the modified stream 126 of frequency coefficients. In sonic embodiments, each filter coefficient of the set is modified in this manner. In other embodiments, only a subset of the filter coefficients is modified. For example, the watermarking module 106 may be configured to modify only one-quarter or one-half of the filter coefficients of the set. Those filter coefficients not selected for modification are output without modification as part of the modified stream 126 of filter coefficients. Accordingly, at block 210 the watermarking module 106 determines whether it has modified all of the filter coefficients of the audio block that are to be modified. If not, the method flow returns to block 208 for the selection of the next frequency coefficient of the set that is to be modified. If watermarking of the set of filter coefficients of the audio block has completed, the method 200 returns to block 202 to repeat the watermarking process for the next audio block with the next bit value of the watermark data 124.

Concurrently, at block 212 the final encoding module 138 completes the encoding of the audio block using the modified set of frequency coefficients in the modified stream 126, rather than the original set of frequency coefficients generated from the audio block. This encoding can include any of a variety of well-known encoding processes in accordance with the audio encoding standard being applied, such as quantization of the modified set of frequency coefficients using a psychoacoustic model, redundancy-elimination coding of the resulting quantized frequency coefficients, error correction coding, and the like. The resulting encoded audio data for the audio block is buffered at the output buffer 110 and then included as part of the output audio data 128 transmitted to a destination device for storage or subsequent decoding.

Figure 3:
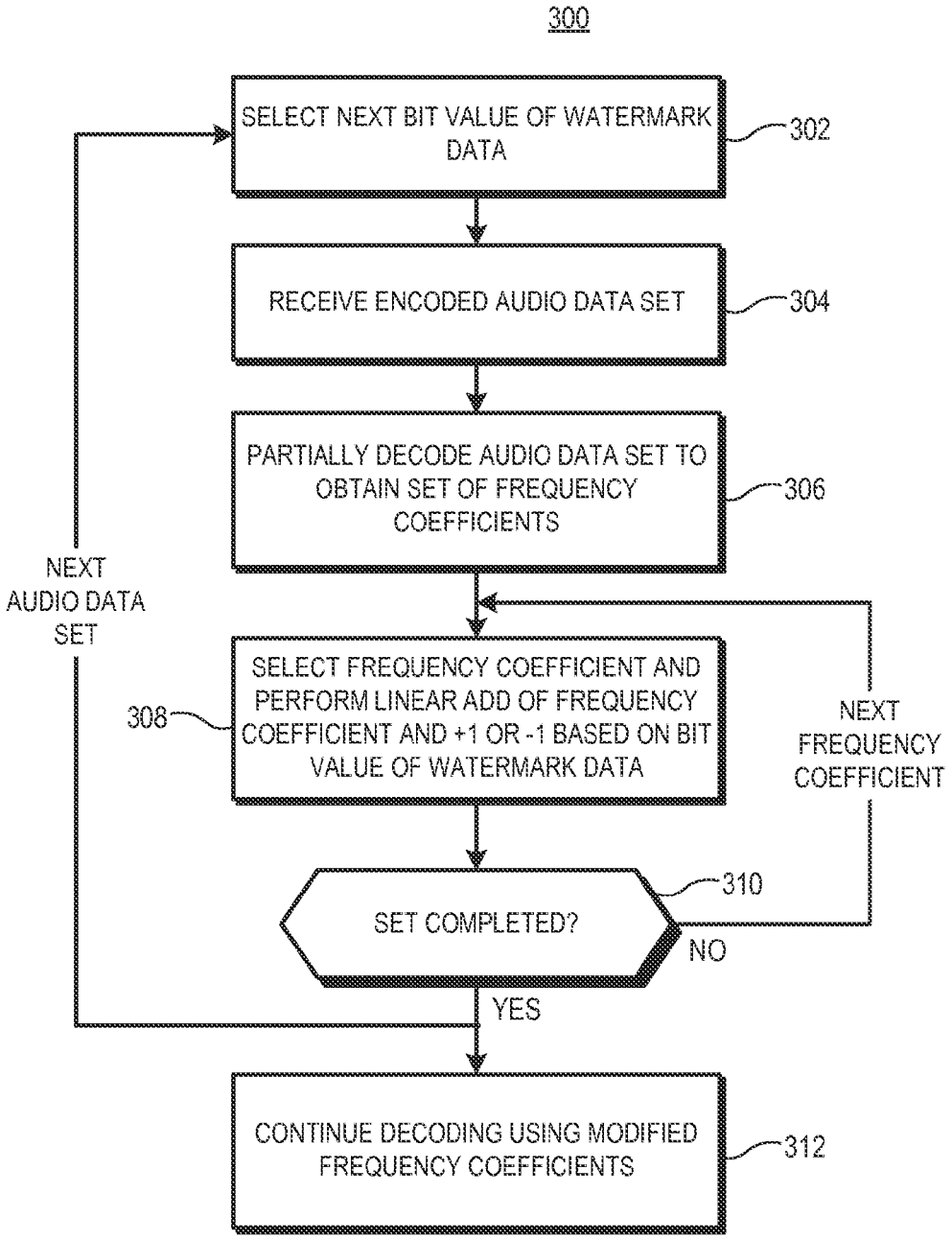
FIG. 3 is a flow diagram illustrating an operation of the audio processing device for watermarking during an audio decoding process in accordance with at least one embodiment of the present disclosure.

FIG. 3 illustrates an example method 300 of operation of the audio processing device 100 of FIG. 1 in a decoding context in accordance with at least one embodiment. As with the encoding method 200 above, in a first iteration of the method 300, the watermarking module 106 selects the first bit value of the watermark data 124 at block 302. At block 304, the audio processing device 100 receives and buffers an audio data set of the input audio data 120, whereby the audio data set comprises a corresponding portion of an encoded audio file or other stream (e.g., a block of AAC or MP3 encoded data). This data set comprises a set of coded frequency coefficients for a corresponding unencoded audio block. Accordingly, at block 306, the initial decoding module 144 performs a partial decode process to obtain the set of frequency coefficients in unencoded form for inclusion in the stream 122 of frequency coefficients supplied to the watermarking module 106.

Next, at block 308, a frequency coefficient of the set is selected and the watermarking module 106 performs a linear add using the selected frequency coefficient and one of a first value or a second value (e.g., "−1" or "+1") that is selected depending on whether the bit value of the watermark data 124 selected at block 302 is a "0" or a "1". The resulting modified frequency coefficient is output as part of the modified stream 126 of frequency coefficients. As similarly noted above, this modification process may be applied to each frequency coefficient in the set or to only a selected subset. Those filter coefficients not selected for modification are output without modification as part of the modified stream 126 of filter coefficients. Accordingly, at block 310 the watermarking module 106 determines whether it has modified all of the filter coefficients of the set that are to be modified. If not, the method flow returns to block 308 for the selection of the next frequency coefficient of the set that is to be modified. If watermarking of the set of filter coefficients has completed, the method 300 returns to block 302 to repeat the watermarking process for the next audio data set with the next bit value of the watermark data 124.

Concurrently, at block 312 the final decoding module 148 completes the decoding of the audio data set using the modified set of frequency coefficients in the modified stream 126, rather than the original set of frequency coefficients generated from the audio block. This encoding can include any of a variety of well-known decoding processes in accordance with the audio decoding standard being applied, such as a frequency-to-time domain transform process, error correction, and the like. The resulting unencoded audio data for the audio data set is buffered at the output buffer 110 and then output as an unencoded audio block of the output audio data 128 transmitted to a destination device for storage or playback.

Figure 4:
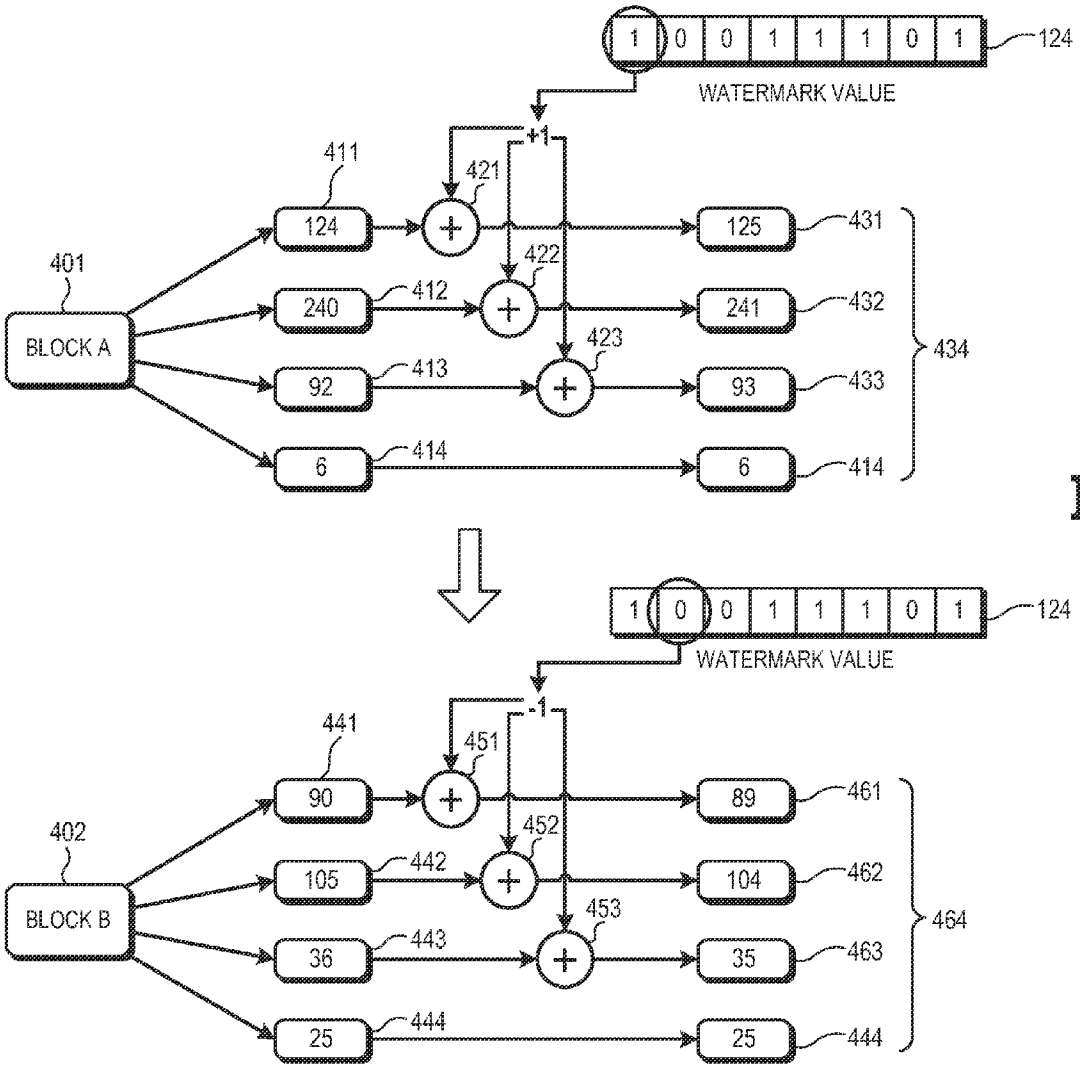
FIG. 4 is a flow diagram illustrating an example watermarking process using a linear add operation with frequency coefficients from a time-to-frequency transform process in accordance with at least one embodiment of the present disclosure.

FIG. 4 illustrates an example of the watermark embedding process employed by the watermarking module 106 to generate the modified stream 126 of frequency coefficients based on the watermark data 124, As noted above, the watermark data 124 comprises a string or set of bit values. In the depicted example, the watermark data 124 comprises an 8-bit value: 10011101b. Further in this example, for a bit value of "0" at a bit position of the watermark data 124, the linear add operation adds a "−1" value to selected frequency coefficients to generate a modified set of frequency coefficients, and for a bit value of "1" at a bit position, the linear add operation adds a "+1" value.

Thus, in the illustrated example, for a first audio block 401 (also denoted "Block A"), the watermarking module 124 implements a time-to-frequency domain transform to generate a set of four frequency coefficients 411, 412, 413, and 414 (note that generally substantially more than four frequency coefficients are generated, but this example is limited to four for ease of illustration). In this example, the frequency coefficients of the lowest three frequency bands (that is, frequency coefficients 411, 412, 413) are selected for modification, and thus linear add operations 421, 422, and 423 are performed using the frequency coefficients 411, 412, and 413, respectively, to generate modified frequency coefficients 431, 432, and 433. In this example, the first bit value of the watermark data 124 is to be embedded in the frequency coefficients generated from the audio block 401. Because this first bit value is a "1", the linear add operations 421, 422, and 423 add a value of "+1" to the values of the frequency coefficients 411, 412, and 413, respectively. These modified frequency coefficients 431, 432, and 433, and the unmodified frequency coefficient 414 are then passed on as a modified frequency coefficient set 434 of the modified stream 126 (FIG. 1).

For a second audio block 402 (also denoted "Block B"), the watermarking module 124 implements a time-to-frequency domain transform to generate a set of four frequency coefficients 441, 442, 443, and 444. As with the processing of the first audio block 401, the frequency coefficients of the lowest three frequency bands (that is, frequency coefficients 431, 432, 433) are selected for modification, and thus linear add operations 451, 452, and 453 are performed using the frequency coefficients 431, 432, and 433, respectively, to generate modified frequency coefficients 461, 462, and 463.

In this example, the second bit value of the watermark data 124 is to be embedded in the frequency coefficients generated from the audio block 402. Because this second bit value is a "0", the linear add operations 451, 452, and 453 add a value of "−1" to the values of the frequency coefficients 441, 442, and 443, respectively. These modified frequency coefficients 461, 462., and 463, and the unmodified frequency coefficient 444 are then passed on as a modified frequency coefficient set 464 of the modified stream 126 (FIG. 1).

In some embodiments, certain aspects of the techniques described above may implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

In this document, relational terms such as "first" and "second", and the like, may be used solely to distinguish one entity or action from another entity or action without necessarily requiring or implying any actual relationship or order between such entities or actions or any actual relationship or order between such entities and claimed elements. The term "another", as used herein, is defined as at least a second or more. The terms "including", "having", or any variation thereof, as used herein, are defined as comprising.

Other embodiments, uses, and advantages of the disclosure will be apparent to those skilled in the art from consideration of the specification and practice of the disclosure disclosed herein. The specification and drawings should be considered as examples only, and the scope of the disclosure is accordingly intended to be limited only by the following claims and equivalents thereof.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed.

Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. A method comprising:

generating, at a processor of an audio processing device, a stream of frequency coefficients based on input audio data;

embedding, at the processor, a digital watermark comprising a set of bit values into the stream of frequency coefficients to generate a modified stream of frequency coefficients, wherein embedding the digital watermark comprises:

for each bit value of the set of bit values, modifying a corresponding set of frequency coefficients of the stream of frequency coefficients based on the bit value to generate a corresponding set of the modified stream of frequency coefficients, wherein modifying the corresponding set of frequency coefficients based on the bit value comprises:

for each frequency coefficient of the set:

performing a linear add of the frequency coefficient and a non-zero first value to generate a corresponding modified frequency coefficient responsive to the bit value comprising a one (1); and performing a linear add of the frequency coefficient and a non-zero second value to generate a corresponding modified frequency coefficient responsive to the bit value comprising a zero (0);

wherein the non-zero first value differs from the non-zero second value; and processing, at the processor, the modified stream of frequency coefficients to generate output audio data.

2. The method of claim 1, wherein:

the input audio data comprises unencoded audio data;

generating the stream of frequency coefficients comprises performing a time-to-frequency domain transform to the unencoded audio data; and the output audio data is encoded audio data.

3. The method of claim 2, wherein the time-to-frequency domain transform comprises at least one of: a Modified Discrete Cosine Transform (MDCT); and a Fast Fourier Transform (FFT).

4. The method of claim 1, wherein:

the input audio data comprises encoded audio data;

generating the stream of frequency coefficients comprises partially decoding the encoded audio data to generate the stream of frequency coefficients; and the output audio data is decoded audio data.

5. The method of claim 1, further comprising:

detecting a presence of the digital watermark in the output audio data.

6. The method of claim 5, wherein detecting the presence of the digital watermark comprises detecting the presence of the digital watermark using at least one of: an average detector; and a most-likelihood detector.

7. An audio processing device comprising:

a non-transitory storage medium to store a set of executable instructions; and at least one processor coupled to the storage medium, the at least one processor to execute the set of executable instructions, wherein the set of executable instructions, when executed by the at least one processor, manipulate the at least one processor to generate a stream of frequency coefficients based on input audio data;

embed a digital watermark comprising a set of bit values into the stream of frequency coefficients to generate a modified stream of frequency coefficients;

process the modified stream of frequency coefficients to generate output audio data;

wherein the set of executable instructions are to manipulate the at least one processor to embed the digital watermark by manipulating the processor to modify, for each bit value of the set of bit values, a corresponding set of frequency coefficients of the stream of frequency coefficients based on the bit value to generate a corresponding set of the modified stream of frequency coefficients; and wherein the set of executable instructions are to manipulate the at least one processor to modify the corresponding set of frequency coefficients based on the bit value by manipulating the at least one processor to:

for each frequency coefficient of the set of frequency coefficients:

perform a linear add of the frequency coefficient and a non-zero first value to generate a corresponding modified frequency coefficient responsive to the bit value comprising a one (1); and perform a linear add of the frequency coefficient and a non-zero second value to generate a corresponding modified frequency coefficient responsive to the bit value comprising a zero (0); and wherein the non-zero first value differs from the non-zero second value.

8. The audio processing device of claim 7, wherein:

the input audio data comprises unencoded audio data;

the set of executable instructions are to manipulate the at least one processor to perform a time-to-frequency domain transform to generate the unencoded audio data; and the output audio data is encoded audio data.

9. The audio processing device of claim 8, wherein the time-to-frequency domain transform comprises at least one of: a Modified Discrete Cosine Transform (MDCT);

and a Fast Fourier Transform (FFT).

10. The audio processing device of claim 7, wherein:

the input audio data comprises encoded audio data;

the set of executable instructions are to manipulate the at least one processor to partially decode the encoded audio data to generate the stream of frequency coefficients; and the output audio data is decoded audio data.

11. A non-transitory computer readable storage medium storing a set of instructions, the set of instructions to manipulate at least one processor to:

generate a stream of frequency coefficients based on input audio data;

embed a digital watermark comprising a set of bit values into the stream of frequency coefficients to generate a modified stream of frequency coefficients, wherein the instructions to manipulate the at least one processor to embed the digital watermark comprise instructions to manipulate the at least one processor to:

for each bit value of the set of bit values, modify a corresponding set of frequency coefficients of the stream of frequency coefficients based on the bit value to generate a corresponding set of the modified stream of frequency coefficients, wherein the instructions to manipulate the at least one processor to modify the corresponding set of frequency coefficients based on the bit value comprise instructions to manipulate the at least one processor to:

for each frequency coefficient of the set:

perform a linear add of the frequency coefficient and a non-zero first value to generate a corresponding modified frequency coefficient responsive to the bit value comprising a one (1); and perform a linear add of the frequency coefficient and a non-zero second value to generate a corresponding modified frequency coefficient responsive to the bit value comprising a zero (0);

wherein the non-zero first value differs from the non-zero second value; and process the modified stream of frequency coefficients to generate output audio data.

12. The non-transitory computer readable storage medium of claim 11, wherein:

the input audio data comprises unencoded audio data;

the set of instructions to manipulate at least one processor to generate the stream of frequency coefficients comprises a set of instructions to manipulate at least one processor to perform a time-to-frequency domain transform to the unencoded audio data; and the output audio data is encoded audio data.

13. The non-transitory computer readable storage medium of claim 12, wherein the time-to-frequency domain transform comprises at least one of: a Modified Discrete Cosine Transform (MDCT); and a Fast Fourier Transform (FFT).

14. The non-transitory computer readable storage medium of claim 11, wherein:

the input audio data comprises encoded audio data;

the set of instructions to manipulate at least one processor to generate the stream of frequency coefficients comprises a set of instructions to manipulate at least one processor to partially decode the encoded audio data to generate the stream of frequency coefficients; and the output audio data is decoded audio data.

* * * * *